US009404486B2

(12) United States Patent
Takahashi

(10) Patent No.: US 9,404,486 B2
(45) Date of Patent: Aug. 2, 2016

(54) CRYOPUMP, CRYOPANEL STRUCTURE, AND VACUUM EVACUATION METHOD

(71) Applicant: Sumitomo Heavy Industries, Ltd., Tokyo (JP)

(72) Inventor: Kakeru Takahashi, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 294 days.

(21) Appl. No.: 14/079,166

(22) Filed: Nov. 13, 2013

(65) Prior Publication Data

US 2014/0130523 A1 May 15, 2014

(30) Foreign Application Priority Data

Nov. 13, 2012 (JP) ..... 2012-249001

(51) Int. Cl.
*F04B 37/08* (2006.01)

(52) U.S. Cl.
CPC ..... *F04B 37/08* (2013.01)

(58) Field of Classification Search
CPC ..... F04B 37/08
See application file for complete search history.

(56) References Cited

U.S. PATENT DOCUMENTS

| | | | | | |
|---|---|---|---|---|---|
| 4,718,241 | A * | 1/1988 | Lessard | F04B 37/08 | 417/901 |
| 5,305,612 | A * | 4/1994 | Higham | F04B 37/08 | 62/383 |
| 5,357,760 | A * | 10/1994 | Higham | F04B 37/08 | 417/901 |
| 5,386,708 | A * | 2/1995 | Kishorenath | F04B 37/08 | 417/901 |
| 5,582,017 | A * | 12/1996 | Noji | F04B 37/08 | 417/901 |

FOREIGN PATENT DOCUMENTS

| | | | | |
|---|---|---|---|---|
| JP | 01-092591 | A | 4/1989 | |
| JP | H10-266957 | A | 10/1998 | |
| JP | 2009-062891 | A | 3/2009 | |
| JP | 2009062891 | A * | 3/2009 | F04B 37/08 |
| JP | 2012-0471200 | A | 3/2012 | |
| WO | WO-87/02743 | A1 | 5/1987 | |
| WO | WO-2006/036257 | A1 | 4/2006 | |

* cited by examiner

*Primary Examiner* — Emmanuel Duke
(74) *Attorney, Agent, or Firm* — Michael Best & Friedrich LLP

(57) ABSTRACT

A cryopump includes a nested array of cryopanels. A hydrogen molecule incident into a clearance in the nested array of cryopanels is reflected by a cryopanel. The reflected hydrogen molecule is adsorbed by another cryopanel. Each of the cryopanels may have an inverted frustum shape.

16 Claims, 8 Drawing Sheets

CRYOPUMP, CRYOPANEL STRUCTURE, AND VACUUM EVACUATION METHOD

BACKGROUND

1. Technical Field

The present invention relates to a cryopump.

2. Description of Related Art

A cryopump is a vacuum pump that captures and pumps gas molecules by condensing or adsorbing molecules on a cryopanel cooled to an extremely low temperature. A cryopump is generally used to achieve a clean vacuum environment required in a semiconductor circuit manufacturing process or the like. One of the applications of a cryopump includes a case where, for example, a non-condensable gas such as hydrogen makes up most of a gas to be pumped, as in the case of, for example, an ion implantation step. A non-condensable gas can be pumped only after the non-condensable gas is adsorbed by an adsorption area that is cooled to an extremely-low temperature.

SUMMARY

An exemplary purpose of an embodiment of the present invention is to provide a cryopump, a cryopanel structure, and a vacuum evacuation method for high-speed evacuation of a non-condensable gas.

According to one embodiment of the present invention, there is provided a cryopump including: a radiation shield configured to include a shield front end that defines a shield opening, a shield bottom portion that faces the shield opening, and a shield side portion that extends from the shield front end to the shield bottom portion; and a cryopanel assembly configured to be cooled to a temperature that is lower than that of the radiation shield, including a plurality of cryopanels arranged along a direction toward the shield bottom portion from the shield opening, wherein the plurality of cryopanels includes: a first cryopanel including a first inner end portion and a first outer end portion that is directed to the shield side portion; a second cryopanel including a second inner end portion and a second outer end portion that is directed to the shield side portion, wherein a distance from the shield opening to the second inner end portion is longer than a distance from the shield opening to the first inner end portion, wherein a distance from the shield opening to the second outer end portion is longer than a distance from the shield opening to the first outer end portion, and wherein a distance from the shield opening to the second outer end portion is shorter than a distance from the shield opening to the first inner end portion.

According to one embodiment of the present invention, there is provided a cryopump structure including a plurality of cryosorption panels, wherein each of the plurality of cryosorption panels includes an inclined front surface that is close to a cryopump inlet on a radially outer side thereof and that is away from the inlet on a radially inner side thereof, the inclined front surface having a non-adsorption area, and wherein the plurality of cryosorption panels are arranged in a nested manner such that one cryosorption panel out of two adjacent cryosorption panels that is close to the cryopump inlet extends toward the cryopump inlet over a non-adsorption area of the other cryosorption panel that is away from the cryopump inlet.

According to one embodiment of the present invention, there is a cryopump structure including a plurality of cryosorption panels, wherein each of the plurality of cryosorption panels includes an inclined front surface that is close to a cryopump inlet on a radially outer side thereof and that is away from the inlet on a radially inner side thereof, the inclined front surface having an inclination angle toward a radiation shield, and wherein the plurality of cryosorption panels are arranged in a nested manner such that one cryosorption panel out of two adjacent cryosorption panels that is close to the cryopump inlet extends toward the cryopump inlet over an upper end of the other cryosorption panel that is away from the cryopump inlet.

According to one embodiment of the present invention, there is a vacuum evacuation method of pumping hydrogen by a cryopump including a nested array of cryopanels, including: reflecting, by a cryopanel, a hydrogen molecule incident into a clearance in the nested array of cryopanels; and adsorbing a reflected hydrogen molecule by another cryopanel.

Optional combinations of the aforementioned constituting elements, and implementations of the invention in the form of methods, apparatuses, and systems, may also be practiced as additional modes of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

The invention will now be described by reference to the preferred embodiments. This does not intend to limit the scope of the present invention, but to exemplify the invention.

Figure 1:
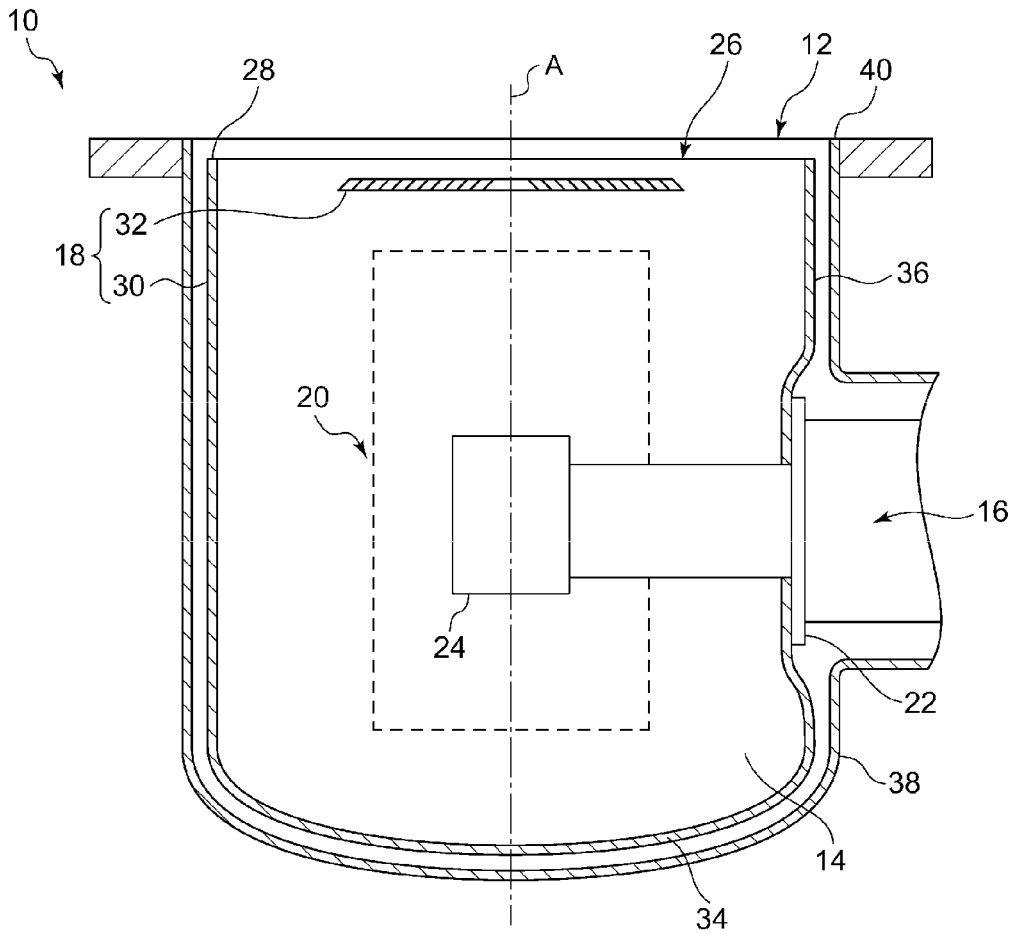
FIG. 1 is a cross-sectional view schematically illustrating a cryopump according to an embodiment of the present invention.

FIG. 1 is a cross-sectional view schematically illustrating a cryopump 10 according to an embodiment of the present invention. FIG. 1 illustrates a cross section including both a central axis A of an internal space 14 of the cryopump 10 and a refrigerator 16.

The cryopump 10 is installed in a vacuum chamber in, for example, an ion implantation apparatus, sputtering apparatus, or the like, to be used for improving the vacuum degree of the inside of the vacuum chamber to a level required in a desired process.

The cryopump 10 has a cryopump inlet 12 serving as an intake port for receiving a gas. The cryopump inlet 12 may be referred to simply as an inlet 12 or a pump inlet 12 in the following. A gas to be pumped enters the internal space 14 of the cryopump 10 via the inlet 12 from the vacuum chamber in which the cryopump 10 is mounted.

In the following, terms "axial direction" and "radial direction" are often used to facilitate the understanding of a positional relationship of constituting elements of the cryopump 10. The axial direction represents a direction passing through the pump inlet 12 (a direction along a dashed-dotted line A in FIG. 1), and the radial direction represents a direction along the inlet 12 (a direction perpendicular to the dashed-dotted line A). For the sake of convenience, relative closeness to the pump inlet 12 in the axial direction may be referred to as "upper" and "upward," and relative remoteness therefrom may be referred to as "lower" and "downward." In other words, relative remoteness from the bottom of the cryopump 10 may be referred to as "upper" and "upward," and relative closeness thereto may be referred to as "lower" and "downward," both in the axial direction. With respect to the radial direction, relative closeness to the center of the pump inlet 12 (a central axis A in FIG. 1) may be referred to as "inner" and "inside," and relative closeness to the circumference of the inlet 12 may be referred to as "outer" and "outside." It should be noted that these expressions are not related to a position of the cryopump 10 as mounted on a vacuum chamber. For example, the cryopump 10 may be mounted on a vacuum chamber in such a manner that the pump inlet 12 faces downward in the vertical direction.

The cryopump 10 is provided with a refrigerator 16. The refrigerator 16 is, for example, a cryogenic refrigerator such as a Gifford-McMahon refrigerator (so-called GM refrigerator). The refrigerator 16 is a two-stage refrigerator provided with a first stage 22 and a second stage 24. The refrigerator 16 is configured to cool the first stage 22 to a first temperature level and cool the second stage 24 to a second temperature level. The second temperature level is lower than the first temperature level. For example, the first stage 22 is cooled to approximately 65 K to 120 K and preferably to 80 K to 100 K, and the second stage 24 is cooled to approximately 10 K to 20 K.

The cryopump 10 illustrated in FIG. 1 is a so-called horizontal-type cryopump. In general, a horizontal-type cryopump is a cryopump arranged such that the refrigerator 16 intersects (orthogonally in general) with the central axis A of the internal space 14 of the cryopump 10. The present invention is also applicable to a so-called vertical-type cryopump in a similar manner. A vertical-type cryopump is a cryopump with a refrigerator arranged along the axial direction of the cryopump.

The cryopump 10 is provided with a high-temperature cryopanel 18 and a low-temperature cryopanel 20. The high-temperature cryopanel 18 is mainly a cryopanel that is provided to protect the low-temperature cryopanel 20 from radiant heat emitted from a cryopump housing 38. The high-temperature cryopanel 18 includes a radiation shield 30 and an inlet cryopanel 32 and surrounds the low-temperature cryopanel 20. The high-temperature cryopanel 18 is thermally connected to the first stage 22. Therefore, the high-temperature cryopanel 18 is cooled to the first temperature level.

The radiation shield 30 is located between the cryopump housing 38 and the low-temperature cryopanel 20 and surrounds the low-temperature cryopanel 20. The radiation shield 30 includes a shield front end 28 that defines a shield opening 26, a shield bottom portion 34 that faces the shield opening 26, and a shield side portion 36 that extends from the shield front end 28 to the shield bottom portion 34.

The radiation shield 30 has an open upper end in the axial direction and is provided with a shield opening 26 at the pump inlet 12. The pump inlet 12 is defined by a front end 40 of the cryopump housing 38. The radiation shield 30 has a tubular shape (e.g., cylindrical) where the shield bottom portion 34 is closed and is formed into a cup-like shape. The shield side portion 36 has a hole for mounting the refrigerator 16, and the second stage 24 is inserted inside the radiation shield 30 via the hole. The first stage 22 is fixed to the outer surface of the radiation shield 30 at the outer circumferential portion of the mounting hole. As described, the radiation shield 30 is thermally connected to the first stage 22.

The inlet cryopanel 32 is arranged such that the inlet cryopanel 32 occupies the central part of the opening area of the pump inlet 12 and forms an annular open area between the radiation shield 30 and the inlet cryopanel 32. The inlet cryopanel 32 is mounted to the shield front end 28 via a panel mounting structure 158 (see FIG. 9). As described, the inlet cryopanel 32 is fixed to the radiation shield 30 and is thermally connected to the radiation shield 30. The inlet cryopanel 32 may be, for example, a disc-shaped baffle. Alternatively, the inlet cryopanel 32 may have a louver shape where the inlet cryopanel 32 is formed concentrically or may have a chevron shape. Although the inlet cryopanel 32 is located close to the low-temperature cryopanel 20, the inlet cryopanel 32 is not in contact with the low-temperature cryopanel 20.

A gas (for example, moisture) that condenses at a cooling temperature of the inlet cryopanel 32 is trapped on the surface thereof. The inlet cryopanel 32 is provided also to protect the low-temperature cryopanel 20 from radiant heat emitted from a heat source outside the cryopump 10 (for example, a heat source inside a vacuum chamber on which the cryopump 10 is mounted).

The low-temperature cryopanel 20 is arranged in a center portion of the internal space 14 of the cryopump 10. For example, the low-temperature cryopanel 20 is arranged in a layout where the low-temperature cryopanel 20 surrounds the central axis A of the radiation shield 30. FIG. 1 shows, by a broken line, an approximate area in which the low-temperature cryopanel 20 is installed. Details of the low-temperature cryopanel 20 will be described later. The low-temperature cryopanel 20 is mounted to the second stage 24 via a panel mounting member 112 (see FIG. 2). The low-temperature cryopanel 20 is thermally connected to the second stage 24 in this way. Thus, the low-temperature cryopanel 20 is cooled to the second temperature level.

An adsorption area is formed on at least part of the surface of the low-temperature cryopanel 20. A detailed explanation thereof will be described later. An adsorption area is provided to capture a non-condensable gas (e.g., hydrogen) by adsorption. The adsorption area is formed by, for example, attaching an adsorbent (e.g., activated charcoal) to the cryopanel surface. A condensation area for capturing a condensable gas by condensing the condensable gas is formed on at least part of the low-temperature cryopanel 20. The condensation area is, for example, a section where the absorbent is absent on a cryopanel surface, exposing the surface (e.g., metal surface) of a cryopanel substrate. Thus, a condensation area can be also called a non-adsorption area. Therefore, the low-temperature cryopanel 20 can be considered as an adsorption panel or a cryosorption panel that has a condensation area (also referred to as non-adsorption area) on part thereof. Also, the low-temperature cryopanel 20 can be considered as a condensation panel or a cryocondensation panel that has an adsorption area on part thereof.

Figure 2:
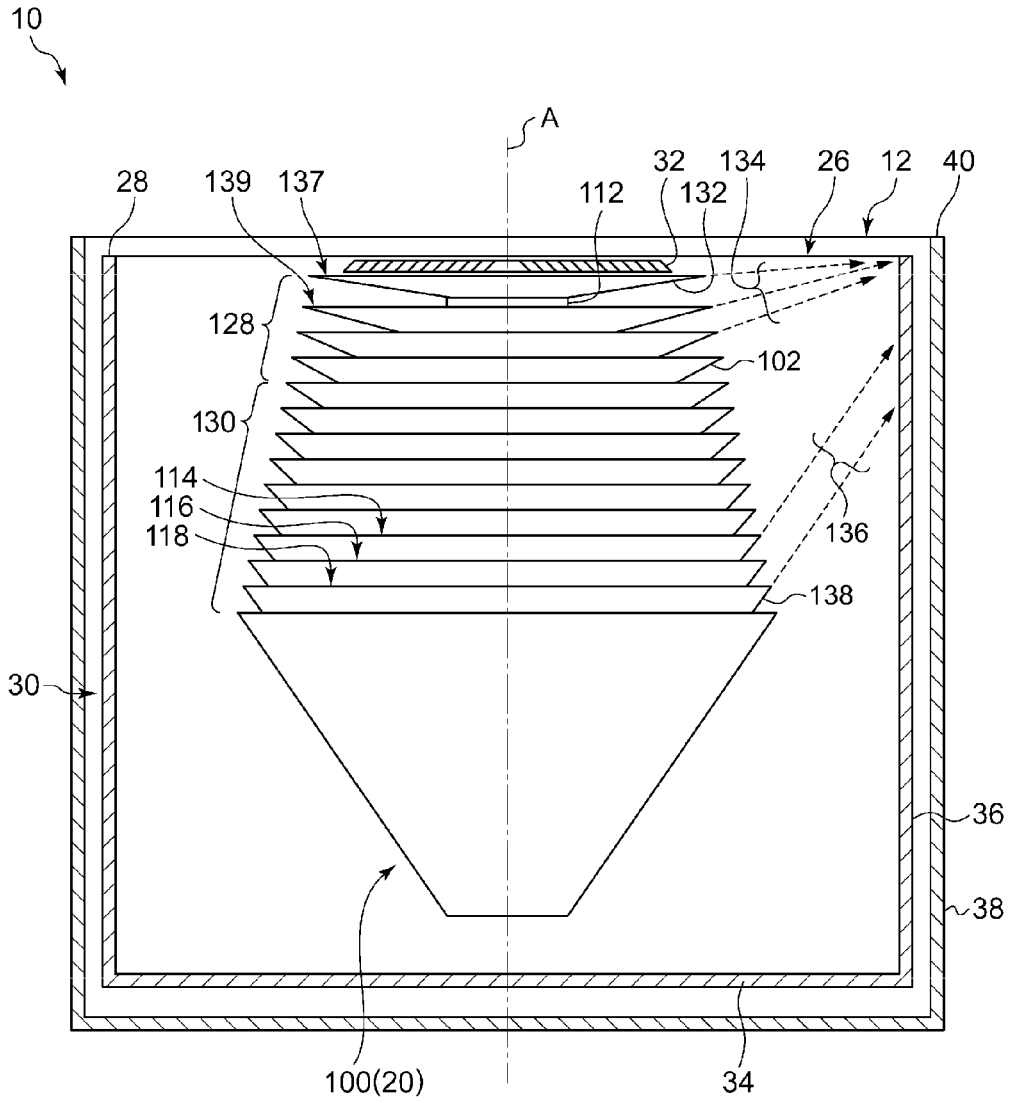
FIG. 2 is a lateral view schematically illustrating a low-temperature cryopanel according to an embodiment of the present invention.

FIG. 2 is a lateral view schematically illustrating a low-temperature cryopanel 20 according to an embodiment of the present invention. The illustration of a refrigerator 16 is omitted in FIG. 2 for the purpose of simplifying the figure. The low-temperature cryopanel 20 is configured as a cryopanel assembly 100 provided with a plurality of cryopanels 102. The plurality of cryopanels 102 are arranged along a direction directed toward a shield bottom portion 34 from a shield opening 26 (i.e., along a central axis A).

In the embodiment shown in FIG. 2, an individual cryopanel 102 has a cryopanel surface that surrounds the central axis A on the outside of the central axis A. The cryopanel assembly 100 is provided with a plurality of inclined cryopanels where the normal of the front surface of a cryopanel 102 extends obliquely upward in a radially inward direction toward the central axis A. The cryopanel assembly 100 has fourteen cryopanels 102.

Figure 3:
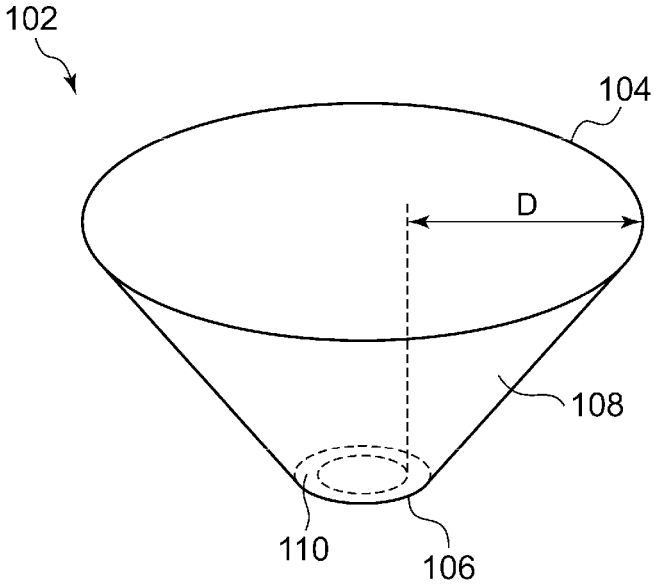
FIG. 3 is a perspective view schematically illustrating a cryopanel according to an embodiment of the present invention.

FIG. 3 is a perspective view schematically illustrating a cryopanel 102 according to an embodiment of the present invention. The cryopanel 102 has the shape of an inverted truncated cone. The cryopanel 102 can be also said to have a mortar shape, a basinal shape, or a ball shape. The cryopanel 102 has a large dimension at an upper end portion 104 (i.e., has a large diameter) and has a small dimension at a lower end portion 106 (i.e., has a small diameter).

The cryopanel 102 is provided with an inclined area 108 connecting the upper end portion 104 and the lower end portion 106. The inclined area 108 represents the side surface of the inverted truncated cone. Therefore, the cryopanel 102 have an inclination such that the normal of the front surface of the cryopanel 102 intersects the central axis A. The inclined area 108 occupies substantially the whole of a width D of the cryopanel in the radial direction.

As shown in FIG. 3, the cryopanel 102 may be provided with a mounting portion 110 at the lower end portion 106. The mounting portion 110 is a flat area. The mounting portion 110 is a flange for mounting the cryopanel 102 on a panel mounting member 112 (see FIG. 2 and FIG. 4). The panel mounting member 112 is provided for mechanically fixing a cryopanel 102 to the second stage 24 of the refrigerator 16 (see FIG. 1) and thermally connecting the cryopanel 102 to the second stage 24. The cryopanel 102 can be easily mounted on the panel mounting member 112 by providing such a flat mounting flange.

The shape of a cryopanel 102 is not limited to an inverted truncated cone shape. Alternatively, a cryopanel 102 may have another arbitrary shape, for example, an inverted frustum shape. The inclined area 108 may occupy at least a half of the width D of the cryopanel in the radial direction from the central axis of the cryopanel 102. The inclined area 108 may be provided at the outer circumferential portion of the cryopanel 102. In this case, parts other than the inclined area 108 of the cryopanel 102 (e.g., inner circumferential portion) may extend horizontally along the radial direction. The mounting portion 110 for mounting the cryopanel 102 on a panel mounting member 112 (see FIG. 3) is not limited to a flat portion that extends horizontally on a surface perpendicular to the central axis of the cryopanel 102. The mounting portion 110 may be, for example, an arbitrary non-inclined area that includes a flat portion extending in a vertical direction along the central axis of the cryopanel 102.

A cutout or an opening (not shown) for insertion of the refrigerator 16 may be formed in the cryopanel 102.

The plurality of cryopanels 102 are arranged coaxially with the central axis A of the radiation shield 30, as illustrated in FIG. 2. Therefore, the inclined area 108 of each of the plurality of cryopanels 102 is away from the shield opening 26 at the lower end portion 106, which is close to the central axis A (see FIG. 3), and is inclined to be close to the shield opening 26 at the upper end portion 104, which is far from the central axis A. The inclined area 108 occupies substantially the whole of the width of the cryopanel 102 from the central axis A in the radial direction. A cryopanel 102 that is close to the pump inlet 12 is smaller than a cryopanel 102 that is far from the pump inlet 12. Of two cryopanels 102 that are adjacent to each other, the upper cryopanel has a smaller diameter than that of the lower cryopanel 102. In this way, a clearance for receiving a hydrogen gas is formed between the upper cryopanel and the lower cryopanel.

Figure 4:
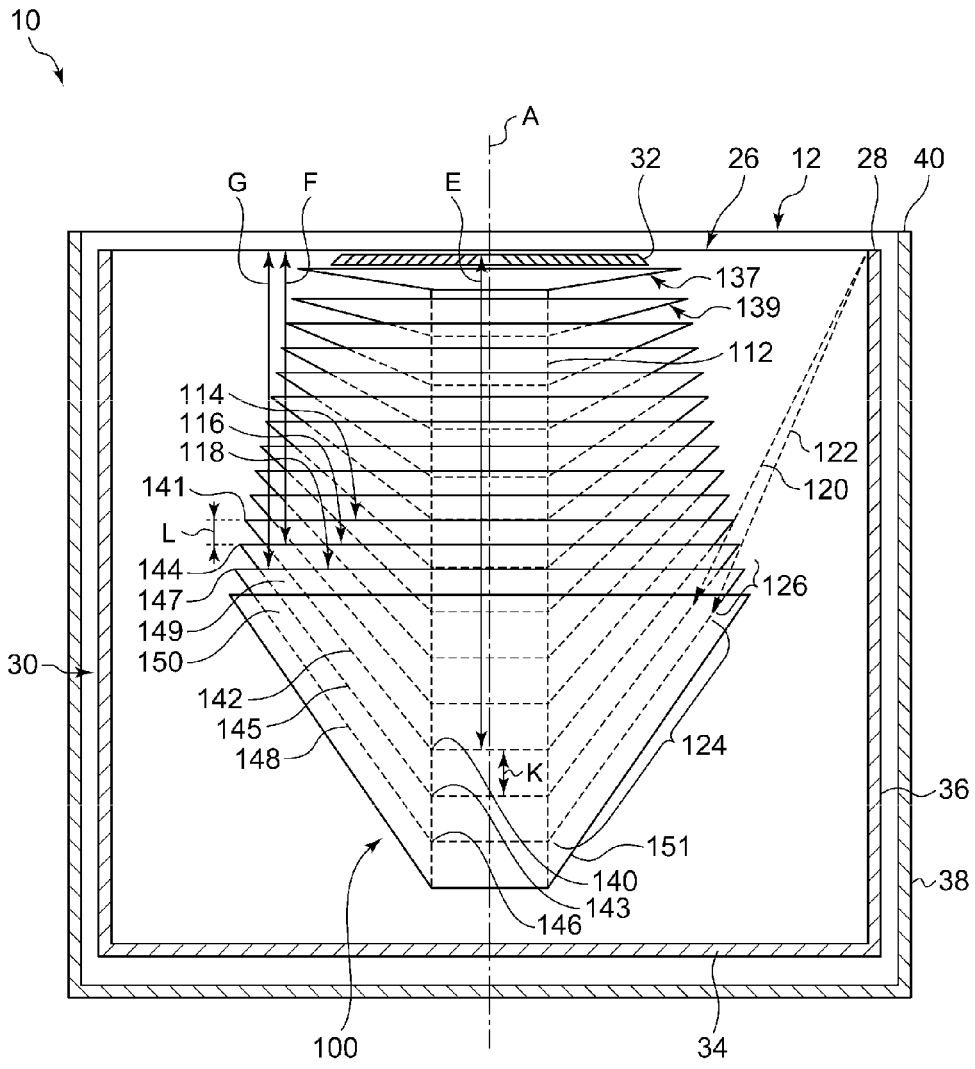
FIG. 4 is a view for explaining the arrangement of the cryopanel shown in FIG. 2.

FIG. 4 is a view for explaining the arrangement of the cryopanel shown in FIG. 2. FIG. 4 shows, by a broken line, the internal structure of the cryopanel assembly 100 shown in FIG. 2.

In the cryopanel assembly 100, a plurality of cryopanels 102 are arranged in a nested manner. An explanation is given in the following regarding this cryopanel arrangement using, for example, three cryopanels 114, 116, and 118 that are adjacent to one another as examples. The upper cryopanel 114 close to the pump inlet 12 is referred to as a first cryopanel 114. Of the three cryopanels, the intermediate cryopanel 116 is referred to as a second cryopanel 116, and the lower cryopanel 118 far from the pump inlet 12 is referred to as a third cryopanel 118. In FIG. 2, the first cryopanel 114 is the fourth cryopanel from the bottom, the second cryopanel 116 is the third cryopanel from the bottom, and the third cryopanel 118 is the second cryopanel from the bottom.

In the following, an explanation is given regarding a positional relationship using the three cryopanels 114, 116, and 118. It should be understood that other cryopanels also have a similar relationship, as shown in the figure.

A first line of sight 120 and a second line of sight 122 from the shield front end 28 are illustrated by broken lines in FIG. 4 for explanation. The first line of sight 120 is a line of sight from the shield front end 28 to the exterior end of the first cryopanel 114. The second line of sight 122 is a line of sight from the shield front end 28 to the exterior end of the second cryopanel 116.

The trajectory of the first line of sight 120 on the front surface of the second cryopanel 116 provides a boundary between the adsorption area 124 and the condensation area 126 on the front surface of the second cryopanel 116. The trajectory of the second line of sight 122 on the front surface of the third cryopanel 118 provides a boundary between the adsorption area 124 and the condensation area 126 on the front surface of the third cryopanel 118. In the same way, a boundary between a adsorption area 124 and a condensation area 126 can be determined for the rest of the cryopanels 102.

Therefore, in a cryopanel 102 that is far from the pump inlet 12, the area ratio of the adsorption area 124 on the front surface of the cryopanel is large. On the other hand, in a cryopanel 102 that is close to the pump inlet 12, the adsorption area 124 either have a small area ratio on the front surface of the cryopanel or does not exist, leaving the entire area of the front surface to be a condensation area 126. In particular, in a top cryopanel 137, which is the closest to the pump inlet 12, the entire area of the front surface is a condensation area 126. The entire area of the respective front surfaces of a few or several cryopanels that are the closest to the pump inlet 12 may be a condensation area 126.

FIG. 2 is referred back. The cryopanel assembly 100 is divided into an upper structure 128 and a lower structure 130. The upper structure 128 includes at least one cryopanel 102, and said at least one cryopanel 102 is provided with an inclined area 108 that has an inclination angle toward the shield front end 28 (see FIG. 3). The cryopanel 102 having such an inclination may be referred to as an upper cryopanel in the following. The inclination angle of a cryopanel is an angle between a plane perpendicular to the central axis A and the surface of a cryopanel 102.

The upper cryopanel 102 has an inclination angle that is adjusted such that a back surface 132 thereof is not visible from the outside of the cryopump 10. In other words, the inclination angle of the back surface 132 (i.e., inclined area 108) is determined such that the line of sight from the shield front end 28 does not intersect the back surface 132. Therefore, the respective exterior ends of the upper cryopanels 102 are directed to a point slightly below the shield front end 28, as shown by a broken-line arrow 134 in FIG. 2. Therefore, each upper cryopanel 102 has a different inclination angle, and an inclination angle becomes smaller toward the pump inlet 12. There can be a situation where a line of sight from the front end 40 of the cryopump housing 38, instead of the shield front end 28, needs to be taken into consideration so that the back surface 132 of an upper cryopanel 102 is not visible from the outside of the cryopump 10.

The lower structure 130 of the cryopanel assembly 100 includes at least one cryopanel 102. Said at least one cryopanel 102 is provided with an inclined area 108 (see FIG. 3) that is inclined toward the shield side portion 36, as shown by a broken-line arrow 136 in FIG. 2. The cryopanel 102 having such an inclination may be referred to as a lower cryopanel in the following. In other words, since the lower cryopanel 102 has an inclination angle toward the shield side portion 36, a back surface 138 thereof is not visible from the outside of the cryopump 10. All lower cryopanels 102 have the same inclination angle.

The adsorbent is provided on the entire area of the back surface 132 of the upper cryopanel 102. The adsorbent is also provided on the entire area of the back surface 138 of the lower cryopanel 102. In this way, each of the plurality of cryopanels 102 is provided with the adsorption area 124 at a site that is invisible from the outside of the cryopump 10. Thus, the cryopanel assembly 100 is configured such that the adsorption area 124 is completely invisible from the outside of the cryopump 10.

A gas accumulated in a cryopump is normally discharged substantially completely by a regeneration process. When the regeneration process is completed, the cryopump is recovered to have pumping performance according to the specifications. However, some constituents of an accumulated gas are relatively more likely to remain in the adsorbent even after the regeneration process.

For example, it has been observed in a cryopump installed for vacuum evacuation of an ion implantation apparatus that adhesive materials attach to activated charcoal that serves as the adsorbent. It has been difficult to completely remove these adhesive materials even by the regeneration process. These adhesive materials are considered to result from an organic outgas that is discharged from a photoresist coating on a substrate to be processed. It is also possible that these adhesive materials result from a poisonous gas used as a dopant gas, i.e., a source gas during an ion implantation process. There is also a possibility that the adhesive materials result from other byproduct gases in the ion implantation process. It is also possible the adhesive materials are created due to the complex interaction of these gases.

Most of the gas pumped by a cryopump can be hydrogen gas in the ion implantation process. The hydrogen gas is substantially completely discharged to the outside by the regeneration. If there is only a tiny amount of a hard-to-regenerate gas, an insignificant effect on the pumping performance of the cryopump will be found after a single cryopumping process. However, it is possible that the hard-to-regenerate gas is gradually accumulated in the adsorbent through the repetition of cryopumping and regeneration processes, thereby lowering the pumping performance. When the pumping performance drops below an acceptable range, maintenance work including, for example, as an exchange of either an adsorbent or a cryopanel along with the adsorbent, or a chemical process of removing a hard-to-regenerate gas performed on the adsorbent, will be required.

Almost without exception, the hard-to-regenerate gas is a condensable gas. Molecules of the condensable gas that fly toward the cryopump 10 from the outside reach the radiation shield 30 or the condensation area 126 at the outer circumference of the cryopanel assembly 100 in a straight route through the open area around the inlet cryopanel 32 and are captured on the surfaces thereof. By avoiding the exposure of the adsorption area to the pump inlet 12, the adsorption area is protected from the hard-to-regenerate gas contained in a gas entering the cryopump 10. The hard-to-regenerate gas is accumulated in the condensation area. In this way, both the protection of the adsorption area from the hard-to-regenerate gas and the high-speed pumping of a non-condensable gas can be achieved. Prevention of the exposure of the adsorption area is also useful in protecting the adsorption area from moisture.

As described above, the cryopanels 102 are arranged in a nested manner. Each cryopanel 102 is provided with a condensation area 126 at the outer end portion of the inclined area 108 on the front surface thereof. The upper end portion 104 of the first cryopanel 114 extends toward the pump inlet 12 (more properly, obliquely upward) over the condensation area 126 of the second cryopanel 116 (i.e., upper end portion 104). The second cryopanel 116, which is far from the pump inlet 12, surrounds a large part of the inclined area 108 and the lower end portion 106 of the first cryopanel 114, which is near the pump inlet 12. In this way, the plurality of cryopanels 102 is densely arranged overlapped with each other in the axial direction.

As shown in FIG. 2 and FIG. 4, of the plurality of cryopanels 102, the top cryopanel 137, which is the closest to the inlet cryopanel 32, does not overlap in the axial direction with an upper cryopanel 139, which is the second closest to the inlet cryopanel 32. As described, the upper structure 128 of the cryopanel assembly 100 may include at least one cryopanel that is distantly arranged in the axial direction.

In an embodiment, at least some or all cryopanels 102 of the upper structure 128 may be arranged in parallel as in the case of the cryopanels 102 of the lower structure 130. Manufacturing is easy when all the cryopanels are arranged in parallel. In this case, a distal end of the top panel 137 may be directed to (slightly downward of) the front end of the cryopump, and the cryopanels that are below the top panel 137 may be directed to the shield side portion 36.

As shown in FIG. 4, the first cryopanel 114 has a first inner end portion 140, a first outer end portion 141, and a first inclined portion 142 connecting the first inner end portion 140 and the first outer end portion 141. A second cryopanel 116 has a second inner end portion 143, a second outer end portion 144, and a second inclined portion 145 connecting the second inner end portion 143 and the second outer end portion 144. A third cryopanel 118 has a third inner end portion 146, a third outer end portion 147, and a third inclined portion 148 connecting the third inner end portion 146 and the third outer end portion 147.

These cryopanels 114, 116, and 118 are arranged in a nested manner in the axial direction as described above. The inner end portions 140, 143, and 146 corresponds to the lower end portion 106 (see FIG. 3), and the outer end portions 141, 144, and 147 corresponds to the upper end portion 104 (see FIG. 3). The inner end portions 140, 143, and 146 are mounted on the panel mounting member 112, and thus the respective bottom portions of the cryopanels 114, 116, and 118 are closed. The outer end portions 141, 144, and 147 define the respective inlet openings of the cryopanels 114, 116, and 118, which are open toward the pump inlet 12. The outer end portions 141, 144, and 147 are directed toward the shield side portion 36.

The inclined portions 142, 145, and 148 corresponds to the inclined area 108 (see FIG. 3) and extend from the inner end portions 140, 143, and 146 toward the outer end portions 141, 144, and 147 in a linear manner, respectively. The inclined portions 142, 145, and 148 extend radially outward from the central axis A toward the shield opening 26 from the shield bottom portion 34. Therefore, there is a first clearance 149 extending obliquely upward in a radially outward direction in a linear manner from the proximity of the central axis A between the first cryopanel 114 and the second cryopanel 116. There is a second clearance 150 extending obliquely upward in a radially outward direction in a linear manner from the proximity of the central axis A between the second cryopanel 116 and the third cryopanel 118. In this way, the cryopanels 114, 116, and 118 are arranged such that the cryopanels 114, 116, and 118 reflect, toward the central axis A, gas molecules that have entered the clearances 149 and 150 between the cryopanels 114, 116, and 118 by the respective upper inclined surfaces of the inclined portions 142, 145, and 148, respectively.

Arranged closer to the pump inlet 12 are the first cryopanel 114, the second cryopanel, and the third cryopanel in said order. Therefore, a distance to the second inner end portion 143, a distance to the second inclined portion 145, and a distance to the second outer end portion 144 all from the shield opening 26 are longer than a distance to the first inner end portion 140, a distance to the first inclined portion 142, and a distance to the first outer end portion 141 all from the shield opening 26, respectively. In the same way, a distance to the third inner end portion 146, a distance to the third inclined portion 148, and a distance to the third outer end portion 147 all from the shield opening 26 are longer than the distance to the second inner end portion 143, the distance to the second inclined portion 145, and the distance to the second outer end portion 144 all from the shield opening 26, respectively.

Also, a distance F to the second outer end portion 144 from the shield opening 26 is shorter than a distance E to the first inner end portion 140 from the shield opening 26. Further, a distance G to the third outer end portion 147 from the shield opening 26 is shorter than the distance E to the first inner end portion 140 from the shield opening 26. As described, compared to the inner end portion of one given topside cryopanel, the respective outer end portions of some cryopanels located below the topside cryopanel are closer to the pump inlet 12. In other words, the inclined portion of one given bottom-side cryopanel extends obliquely upward over the respective inner end portions of some cryopanels located above the bottom-side cryopanel. As described, a plurality of cryopanels 102 are arranged in a nested manner.

Such a positional relationship among cryopanels also applies to some cryopanels in the upper structure 128 as well as the lower structure 130. This positional relationship is prominent in the lower structure 130. For example, the outer end portion of the bottommost cryopanel 151 is closer to the pump inlet 12 than the respective inner end portions of six cryopanels that are located just above the bottommost cryopanel 151.

In this way, the deep and narrow clearances 149 and 150 are formed between the cryopanels 114, 116, and 118. These clearances 149 and 150 extend deeply toward the inner end portions 140, 143, and 146 from the respective clearance inlets of the outer end portions 141, 144, and 147, respectively. The respective depths of the clearances are larger than the respective widths of the clearance inlets. The depth of a clearance represents a distance to the inner end portion from the outer end portion or a length of the inclined portion from the outer side to the inner side in the radial direction. Having such a deep clearance structure, the cryopanel assembly 100 can increase the rate of capturing the hydrogen gas. In other words, the cryopanel assembly 100 can capture hydrogen molecules that have once entered the clearances 149 and 150 without letting the hydrogen molecules escape to the outside as possible.

Figure 5:
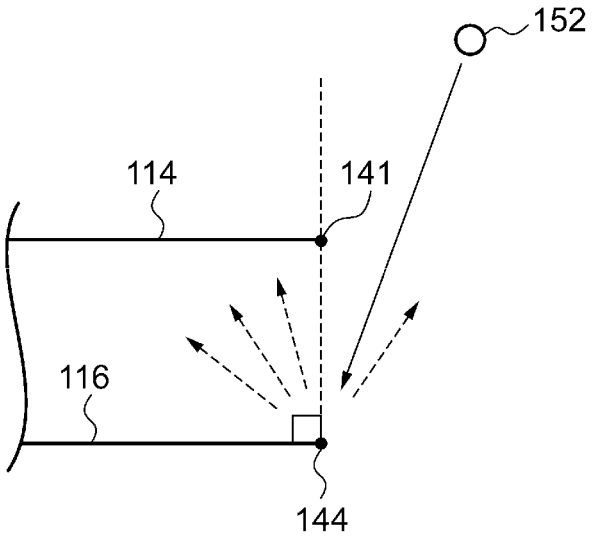
FIG. 5 is a view for explaining the behavior of a hydrogen molecule when the hydrogen molecule collides against a cryopanel.
Figure 6:
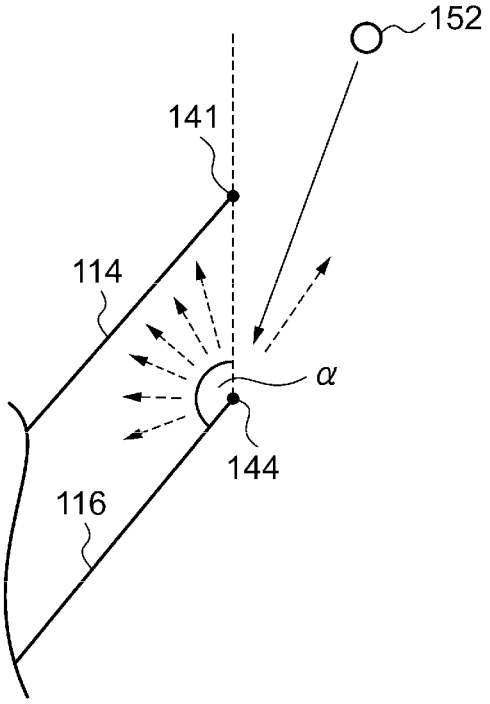
FIG. 6 is a view schematically illustrating part of a cryopanel according to an embodiment of the present invention.

FIGS. 5 and 6 are views for explaining the behavior of a hydrogen molecule when the hydrogen molecule collides against a cryopanel. In a cryopanel arrangement shown in FIG. 5, a first cryopanel 114 and a second cryopanel 116, which are flat panels, are arranged in parallel. The first cryopanel 114 and the second cryopanel 116 extend along a surface that is perpendicular to a cryopump central axis. A first outer end portion 141 is arranged immediately above a second outer end portion 144.

The behavior of a hydrogen molecule 152 (or other gas molecules) on a cryopanel surface at the time of collision can be basically considered just like the reflection of light. The hydrogen molecule 152, however, is not simply reflected specularly on the cryopanel surface. The hydrogen molecule 152 is once captured momentarily on the cryopanel surface and is then released again from the cryopanel surface immediately after that. Accordingly, the direction in which the hydrogen molecule 152 is released is probabilistic and is not constant. The hydrogen molecule 152 can be considered to be released at almost an equal probability in all directions. Therefore, the reflection of the hydrogen molecule 152 is similar to diffused reflection of light. In FIGS. 5 and 6, the trajectory of an incoming hydrogen molecule 152 is illustrated by a solid arrow, and the trajectory of a reflected hydrogen molecule 152 is illustrated by a broken-line arrow.

In a cryopanel arrangement shown in FIG. 5, an angular range covered by the first cryopanel 114 when the first cryopanel 114 is viewed from the second outer end portion 144 is equal to exactly 90 degrees. Therefore, a hydrogen molecule 152 reflected from the second outer end portion 144 is directed to the back surface of the first cryopanel 114 with a probability of approximately 1/2 and is directed in a direction away from the first cryopanel 114 with a probability of approximately 1/2.

On the other hand, in a cryopanel arrangement shown in FIG. 6, a first cryopanel 114 and a second cryopanel 116 are inclined with respect to a cryopump central axis such that respective outer end portions 141 and 144 are directed obliquely upward. The first outer end portion 141 is arranged immediately above the second outer end portion 144. As shown in FIGS. 2 and 4, the second outer end portion 144 may be located radially outward of the first outer end portion 141.

In the cryopanel arrangement shown in FIG. 6, an angular range a covered by the first cryopanel 114 when the first cryopanel 114 is viewed from the second outer end portion 144 exceeds 90 degrees. Therefore, a hydrogen molecule 152 reflected from the second outer end portion 144 is directed to the back surface of the first cryopanel 114 with a probability larger than 1/2. The probability of a hydrogen molecule 152 being directed to the first cryopanel 114 from the second outer end portion 144 is determined by an angle $\alpha$. A proportion of the angle α in the entire possible reflection range (e.g., 180 degrees) of a hydrogen molecule 152 provides this probability. In this way, more hydrogen molecules 152 can be reflected toward the adjacent cryopanel.

FIG. 4 is referred back again. An interval L between the first outer end portion 141 of the first cryopanel 114 and the second outer end portion 144 of the second cryopanel 116 is narrower than an interval K between the first inner end portion 140 of the first cryopanel 114 and the second inner end portion 143 of the second cryopanel 116. In other words, a clearance inlet L between the cryopanels is narrower than a cryopanel mounting interval K. In this way, the clearance inlet L between the cryopanels can be brought close to the pump inlet 12.

The cryopanel assembly 100 is provided close to the inlet cryopanel 32. Therefore, more cryopanels can be arranged in the axial direction. In a case where a reduction in heat entering the cryopanel assembly 100 is emphasized, a space between the cryopanel assembly 100 and the inlet cryopanel 32 may be enlarged.

Figure 7:
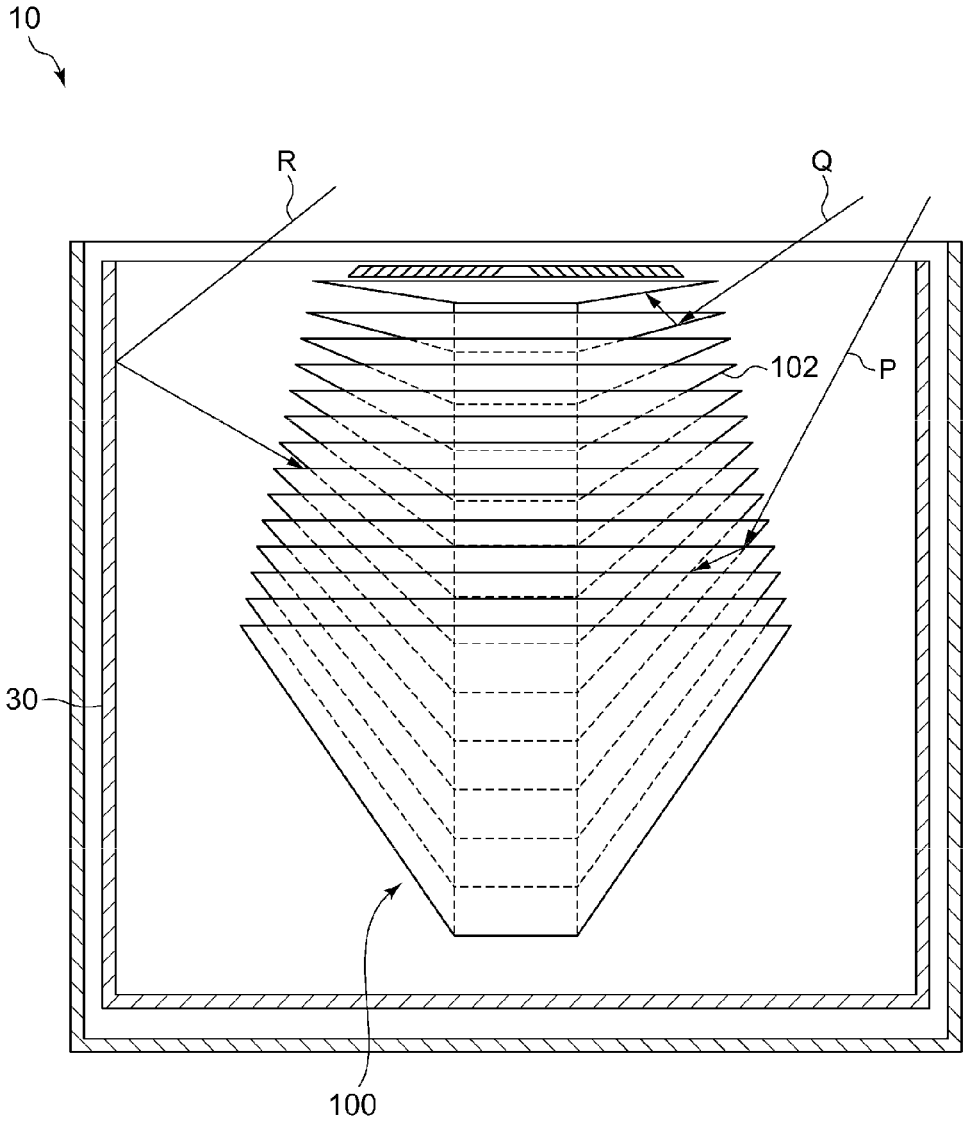
FIG. 7 is a view for explaining a hydrogen gas vacuum evacuation method according to an embodiment of the present invention.

FIG. 7 is a view for explaining a method for vacuum pumping of hydrogen gas according to an embodiment of the present invention. As described above, a cryopump 10 is provided with a nested array of cryopanels 102. This vacuum evacuation method includes reflecting a hydrogen molecule incident into a clearance in the nested array of cryopanels from a cryopanel 102 of the nested array of cryopanels, and adsorbing the reflected hydrogen molecule by another cryopanel 102 of the nested array of cryopanels.

For example, as shown by an arrow P in FIG. 7, a hydrogen molecule entering the cryopump 10 can be received in a deep and narrow clearance between cryopanels 102. The hydrogen molecule that has entered the clearance is introduced deep into the clearance by reflection on the cryopanel surfaces. As shown by an arrow Q, a hydrogen molecule that has hit the front surface of an upper cryopanel is reflected toward the back surface of a cryopanel right above the upper cryopanel. Also, as shown by an arrow R, a hydrogen molecule reflected by a radiation shield can be also received in a deep and narrow clearance between cryopanels 102.

As described, the cryopanel assembly 100 is configured such that a hydrogen molecule that has entered the cryopump 10 is introduced toward the central part of a cryopanel structure. An adsorption area is formed in the central part of the cryopanel structure. Therefore, the hydrogen molecule can be efficiently adsorbed, and high-speed pumping of hydrogen gas can be achieved.

The cryopump suggested earlier by the present applicant is also provided with a unique cryopanel structure that achieves both the high-speed pumping of hydrogen and the protection of the adsorbent. In this cryopanel structure, individual cryopanels extend toward a radiation shield along a plane that is perpendicular to the central axis of a cryopump. Such a cryopanel structure is illustrated in FIG. 5. Such a cryopump is disclosed in, for example, Japanese Patent Application No. 2011-107669, Japanese Patent Application No. 2011-107670, U.S. patent application Ser. Nos. 13/458,699, and 13/458,751, which are incorporated herein in their entirety by reference.

It has been confirmed that, in comparison with such a cryopump having horizontal cryopanels, the speed of pumping a hydrogen gas is 20 to 30 percent better in a cryopanel having inclined cryopanels according to the present embodiments.

A number of cryopumps are often installed in some vacuum systems. By using a cryopump according to the present embodiment, the number of cryopumps that are installed can be reduced. In other words, equivalent pumping speed can be achieved by a small number of cryopumps. For example, when three cryopumps are substituted for four cryopumps, the cost required for a cryopump system is reduced to approximately ¾. Therefore, the total cost for configuring a vacuum system can be greatly reduced.

Described above is an explanation based on the exemplary embodiments of the present invention. The invention is not limited to the above-mentioned embodiments, and various design modifications may be added. It will be obvious to those skilled in the art that such modifications are also within the scope of the present invention.

Figure 8:
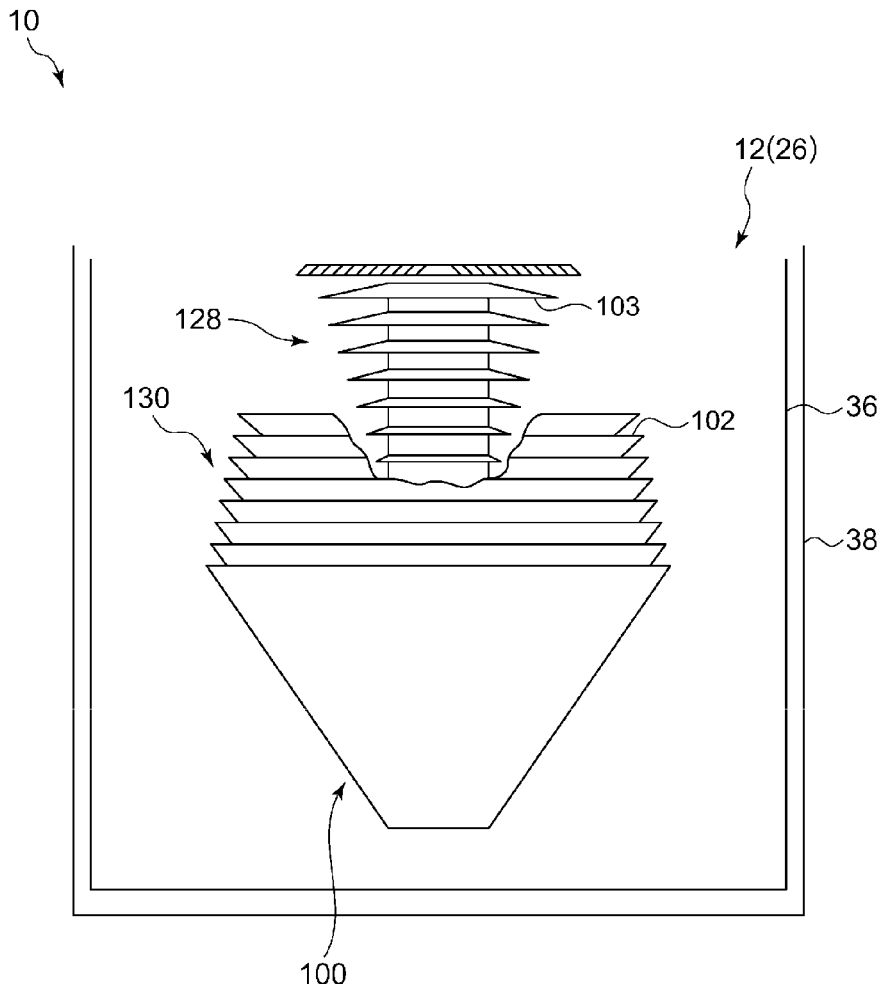
FIG. 8 is a schematic lateral view of a cryopump according to an embodiment of the present invention.

FIG. 8 is a schematic lateral view of a cryopump 10 according to an embodiment of the present invention. The cryopump 10 is provided with a cryopanel assembly 100. The cryopanel assembly 100 is provided with an upper structure 128 and a lower structure 130. The lower structure 130 is configured in the same way as in the above-described embodiment explained in reference to FIG. 2. In FIG. 8, the illustration of the upper central part of the lower structure 130 is omitted for the purpose of illustrating the entire upper structure 128.

The upper structure 128 includes a cryopanel 103 shaped such that the cryopanel 102 having an inverted frustum shape is arranged upside down. In other words, a cryopanel 103 of the upper structure 128 has a frustum shape (e.g., truncated cone shape). A cryopanel 103 may be a flat plate. The size of a cryopanel 103 becomes bigger (larger diameter) as the cryopanel becomes closer to the pump inlet 12. However, even the cryopanel 103 that is the closest to the pump inlet 12 is smaller than the inlet cryopanel 32 and is also smaller than any cryopanel 102 of the lower structure 130. The cryopanel 103 of the upper structure 128 has an adsorption area on the back surface thereof. The cryopanel 103 of the upper structure 128 is capable of adsorbing a hydrogen molecule reflected from a cryopanel 102 of the lower structure 130.

Therefore, the cryopanel assembly 100 includes at least one adsorption panel 103 provided between the shield opening 26 and the cryopanels 102. At least one adsorption panel 103 extends toward the shield side portion 36. At least one adsorption panel 103 is provided with an adsorption area for adsorbing a gas molecule reflected from the cryopanels 102 on the back surface thereof. As described, the upper structure 128 of the cryopanel assembly 100 may be configured as a cryopanel dedicated for adsorption.

Figure 9:
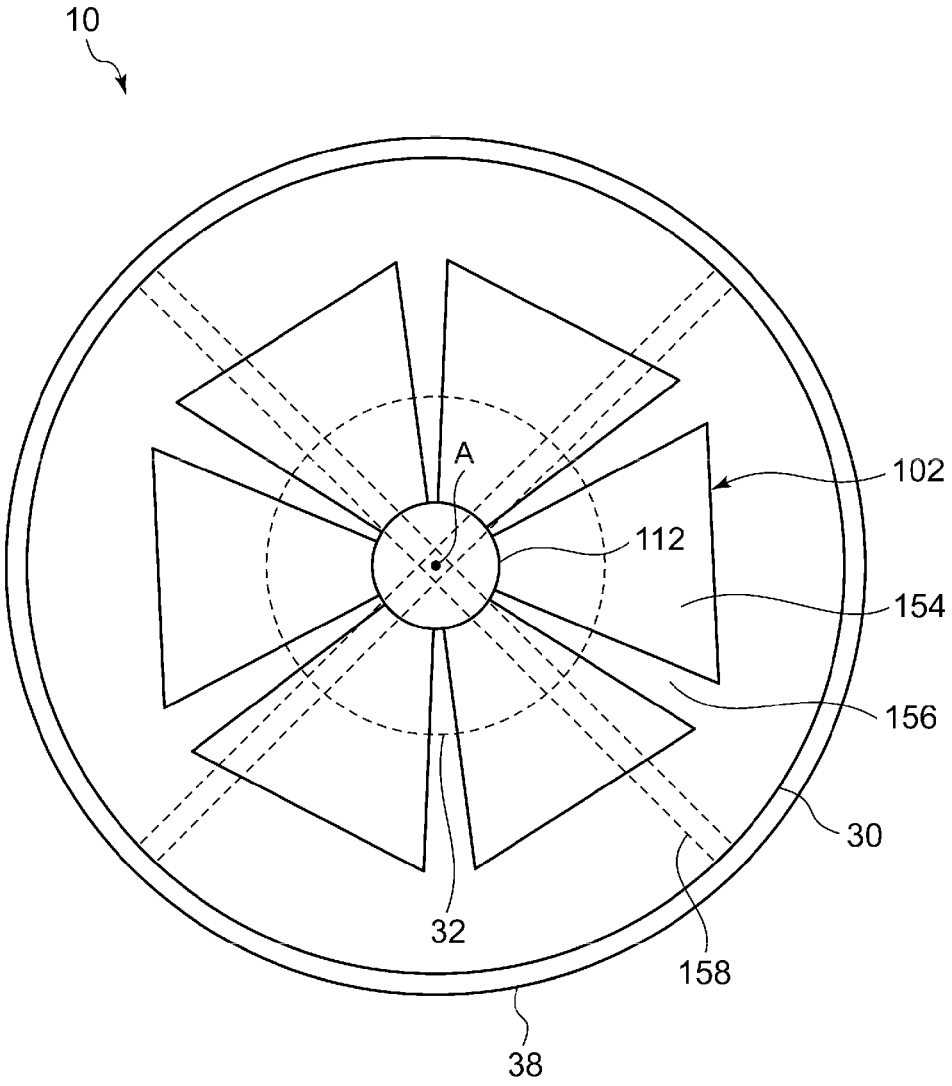
FIG. 9 is a schematic top view of a cryopump according to an embodiment of the present invention.

FIG. 9 is a schematic top view of a cryopump 10 according to an embodiment of the present invention. Only one cryopanel 102 out of a plurality of cryopanels 102 is illustrated in FIG. 9 for the purpose of simplifying the figure.

A cryopanel 102 is divided into a plurality of (e.g., three or more) panel pieces 154, as shown in FIG. 9. In FIG. 9, the cryopanel 102 is divided into six panel pieces 154, and an individual panel piece 154 has a triangular shape. Therefore, a cryopanel 102 has an inverted hexagonal pyramid shape. A panel piece 154 may be formed in any shape, for example, a square shape. The surface of a panel piece 154 may be flat or curved.

A slit 156 is formed between panel pieces 154. A gas molecule can pass through the slit 156 and reach a cryopanel located deep inside thereof. Such a slit 156 may be provided on the cryopanel 102 shown in FIG. 2 or on the cryopanel 102 shown in FIG. 8.

In general, most hydrogen molecules are adsorbed at the outer periphery portion of an adsorption area of the cryopanel assembly 100. By providing the slit 156 on the cryopanel 102, a hydrogen molecule can be introduced closer to the central part of the cryopanel assembly 100 or further deep inside the cryopanel assembly 100. Therefore, uneven distribution of adsorbed hydrogen molecules can be decreased. Since adsorption areas in the central part or the deep part can be utilized, the storage amount of hydrogen can be increased.

The slits 156 may be arranged such that there are more slits 156 on the upper side of the cryopanel assembly 100 and less slits 156 on the lower side thereof. In other words, in the cryopanel assembly 100, the panel pieces 154 may be arranged sparsely in the upper side and densely in the lower side. The slits 156 may not be provided on the lowest cryopanel 102. The slits 156 of a cryopanel 102 may be provided such that the respective positions thereof are shifted from the slits 156 of its adjacent cryopanel 102. For example, the slits 156 may be provided such that the slits 156 are shifted in a spiral manner from the upper side to the lower side in the axial direction.

A plurality of panel pieces 154 that form one given cryopanel 102 are mounted on the panel mounting member 112 at a specific mounting height in the same way as in a single cryopanel 102 that is not divided. Therefore, a mounting plane including a mounting position of an individual panel piece can be considered. This mounting plane is a plane that perpendicular to the central axis A. The plurality of panel pieces may be mounted having a torsion angle with respect to the mounting plane. In this way, a cryopanel 102 may be configured such that a hydrogen molecule reflected on the front surface of a given panel piece 154 of the cryopanel 102 is directed to the back surface of an adjacent panel piece 154 of the same cryopanel 102.

In a preferred embodiment, a cryopanel assembly 100 may be provided with an upper structure 128 including a plurality of adsorption panels 103 (see FIG. 8) and a lower structure 130 including a plurality of cryopanels 102 each having a plurality of slits 156 (see FIG. 9). The slits 156 may not be provided on the lowest cryopanel 102. Such a cryopanel structure can be also referred to as a pineapple type. It has been also confirmed for a pineapple-type cryopanel structure by simulation based on the Monte Carlo method that hydrogen pumping speed can be achieved that is equivalent to that of a cryopanel structure of a mortar shape described above.

FIG. 9 illustrates the inlet cryopanel 32 by a broken line. In addition, FIG. 9 illustrates a cross-shaped panel mounting structure 158 for mounting the inlet cryopanel 32 on the radiation shield 30 by a broken line.

The embodiments of the present invention can be also expressed as follows.

1. A cryopump including:

a radiation shield including a shield front end that defines a shield opening, a shield bottom portion that faces the shield opening, and a shield side portion that extends from the shield front end to the shield bottom portion; and a cryopanel assembly cooled to a temperature that is lower than that of the radiation shield, including a plurality of cryopanels arranged along a direction toward the shield bottom portion from the shield opening, wherein the plurality of cryopanels includes:

a first cryopanel including a first inner end portion and a first outer end portion that is directed to the shield side portion; and a second cryopanel including a second inner end portion and a second outer end portion that is directed to the shield side portion, wherein a distance from the shield opening to the second inner end portion is longer than a distance from the shield opening to the first inner end portion, wherein a distance from the shield opening to the second outer end portion is longer than a distance from the shield opening to the first outer end portion, and wherein a distance from the shield opening to the second outer end portion is shorter than a distance from the shield opening to the first inner end portion.

According to this embodiment, the two cryopanels are arranged such that, although the second cryopanel is located behind the first cryopanel, the outer side of the second cryopanel is closer to the shield opening than the inner side of the first cryopanel. Therefore, a clearance between the two cryopanels extends obliquely upward from the respective inner end portions to the respective outer end portions of these cryopanels. By receiving a hydrogen gas in such a deep and narrow clearance, the hydrogen gas can be introduced to deep inside the clearance. Thus, the hydrogen gas can be captured efficiently.

2. The cryopump according to embodiment 1, wherein the plurality of cryopanels further include a third cryopanel including a third inner end portion and a third outer end portion that is directed to the shield side portion, wherein a distance from the shield opening to the third inner end portion is longer than a distance from the shield opening to the second inner end portion, wherein a distance from the shield opening to the third outer end portion is longer than a distance from the shield opening to the second outer end portion, and wherein a distance from the shield opening to the third outer end portion is shorter than a distance from the shield opening to the first inner end portion.

3. The cryopump according to embodiment 1 or 2, wherein the first cryopanel is arranged with respect to the second outer end portion such that an angular range covered by the first cryopanel when the first cryopanel is viewed from the second outer end portion exceeds 90 degrees.

4. The cryopump according to any one of embodiments 1 through 3, wherein each of the plurality of cryopanels includes an inclined area that is inclined such that the inclined area is away from the shield opening at a site close to a central axis of the radiation shield and is close to the shield opening at a site far from the central axis, and wherein at least half of a width of the cryopanel in a radial direction from the central axis corresponds to the inclined area.

5. The cryopump according to embodiment 4, wherein substantially the whole of the width corresponds to the inclined area.

6. The cryopump according to embodiment 4 or 5, wherein the cryopanel assembly includes a support member configured to support the plurality of cryopanels, and wherein each of the plurality of cryopanels includes a non-inclined area configured to mount the cryopanel on the support member.

7. The cryopump according to any one of embodiments 1 to 6,

Wherein each of the plurality of cryopanels has an inverted frustum shape.

8. The cryopump according to any one of embodiments 1 to 7, wherein the plurality of cryopanels include an adsorption area at a site that is invisible from outside of the cryopump.

9. The cryopump according to any one of embodiments 1 to 8, wherein the cryopanel assembly further includes at least one cryopanel provided between the shield opening and the plurality of cryopanels, and wherein said at least one cryopanel is inclined toward the shield front end or a cryopump housing front end.

10. The cryopump according to embodiment 9, wherein said at least one cryopanel has an inclination angle adjusted such that a back surface thereof is invisible from outside of the cryopump.

11. The cryopump according to any one of embodiments 1 to 10, wherein the cryopanel assembly further includes at least one adsorption panel provided between the shield opening and the plurality of cryopanels, wherein said at least one adsorption panel extends toward the shield side portion, and wherein said at least one adsorption panel includes an adsorption area on a back surface thereof, the adsorption area configured to adsorb a gas molecule reflected from the plurality of cryopanels.

12. The cryopump according to any one of embodiments 1 to 11, wherein a slit is formed on at least one of the plurality of cryopanels in order to allow a gas molecule to pass through said at least one of the plurality of cryopanels.

13. The cryopump according to any one of embodiments 1 to 12, wherein a depth of a clearance formed between the first cryopanel and the second cryopanel is larger than a width of an inlet of the clearance.

14. A cryopump structure including a plurality of cryosorption panels, wherein each of the plurality of cryosorption panels includes an inclined front surface that is close to a cryopump inlet on a radially outer side thereof and that is away from the inlet on a radially inner side thereof, the inclined front surface having a non-adsorption area, and wherein the plurality of cryosorption panels are arranged in a nested manner such that one cryosorption panel out of two adjacent cryosorption panels that is close to the cryopump inlet extends toward the cryopump inlet over a non-adsorption area of the other cryosorption panel that is away from the cryopump inlet.

According to this embodiment, the two adjacent cryosorption panels are arranged in the nested manner. By receiving a hydrogen gas in such a clearance in the nested arrangement, the hydrogen gas can be introduced to deep inside the clearance. Thus, the hydrogen gas can be captured efficiently.

15. The cryopanel structure according to embodiment 14, wherein each of the plurality of cryosorption panels has an inverted frustum shape having a large dimension at a side close to the cryopump inlet and having a small dimension at a side far from the cryopump inlet, and wherein the plurality of cryosorption panels are arranged such that said other cryosorption panel surrounds said one cryosorption panel.

16. The cryopump according to embodiment 14 or 15, wherein the non-adsorption area is formed on an outer circumferential portion of the plurality of cryosorption panels that is visually recognized through the cryopump inlet.

17. A cryopump structure including a plurality of cryosorption panels, wherein each of the plurality of cryosorption panels includes an inclined front surface that is close to a cryopump inlet on a radially outer side thereof and that is away from the inlet on a radially inner side thereof, the inclined front surface having an inclination angle toward a radiation shield, and wherein the plurality of cryosorption panels are arranged in a nested manner such that one cryosorption panel out of two adjacent cryosorption panels that is close to the cryopump inlet extends toward the cryopump inlet over an upper end of the other cryosorption panel that is away from the cryopump inlet.

18. A vacuum evacuation method of pumping hydrogen by a cryopump that includes a nested array of cryopanels, including:

reflecting, by a cryopanel, a hydrogen molecule incident into a clearance in the nested array of cryopanels; and adsorbing a reflected hydrogen molecule by another cryopanel.

It should be understood that the invention is not limited to the above-described embodiment, but may be modified into various forms on the basis of the spirit of the invention. Additionally, the modifications are included in the scope of the invention.

Priority is claimed to Japanese Patent Application No. 2012-249001, filed on Nov. 13, 2012, the entire content of which is incorporated herein by reference.

What is claimed is:

1. A cryopump comprising:

a radiation shield comprising a shield front end that defines a shield opening, a shield bottom portion that faces the shield opening, and a shield side portion that extends from the shield front end to the shield bottom portion; and a cryopanel assembly configured to be cooled to a temperature that is lower than that of the radiation shield, the assembly comprising a plurality of cryopanels arranged along a direction toward the shield bottom portion from the shield opening, wherein the plurality of cryopanels comprises:

a first cryopanel comprising a first inner end portion and a first outer end portion that is directed to the shield side portion;

a second cryopanel comprising a second inner end portion and a second outer end portion that is directed to the shield side portion, wherein a distance from the shield opening to the second inner end portion is longer than a distance from the shield opening to the first inner end portion, wherein a distance from the shield opening to the second outer end portion is longer than a distance from the shield opening to the first outer end portion, and wherein the distance from the shield opening to the second outer end portion is shorter than the distance from the shield opening to the first inner end portion, wherein each of the plurality of cryopanels comprises an inclined area that is inclined such that the inclined area is away from the shield opening at a site close to a central axis of the radiation shield and is close to the shield opening at a site far from the central axis, and wherein at least half of a width of the cryopanel in a radial direction from the central axis corresponds to the inclined area.

2. The cryopump according to claim 1, wherein the plurality of cryopanels further comprises a third cryopanel comprising a third inner end portion and a third outer end portion that is directed to the shield side portion, wherein a distance from the shield opening to the third inner end portion is longer than the distance from the shield opening to the second inner end portion, wherein a distance from the shield opening to the third outer end portion is longer than the distance from the shield opening to the second outer end portion, and wherein the distance from the shield opening to the third outer end portion is shorter than the distance from the shield opening to the first inner end portion.

3. The cryopump according to claim 1, wherein the first cryopanel is arranged with respect to the second outer end portion such that an angular range covered by the first cryopanel when the first cryopanel is viewed from the second outer end portion exceeds 90 degrees.

4. The cryopump according to claim 1, wherein substantially the whole of the width corresponds to the inclined area.

5. The cryopump according to claim 1, wherein the cryopanel assembly comprises a support member configured to support the plurality of cryopanels, and wherein each of the plurality of cryopanels comprises a non-inclined area configured to mount the cryopanel on the support member.

6. The cryopump according to claim 1, wherein each of the plurality of cryopanels has an inverted frustum shape.

7. The cryopump according to claim 1, wherein the plurality of cryopanels comprises an adsorption area at a site that is invisible from outside of the cryopump.

8. The cryopump according to claim 1, wherein the cryopanel assembly further comprises at least one cryopanel provided between the shield opening and the plurality of cryopanels, and wherein said at least one cryopanel is inclined toward the shield front end or a cryopump housing front end.

9. The cryopump according to claim 8, wherein said at least one cryopanel has an inclination angle adjusted such that a back surface thereof is invisible from outside of the cryopump.

10. The cryopump according to claim 1, wherein the cryopanel assembly further comprises at least one adsorption panel provided between the shield opening and the plurality of cryopanels, and wherein said at least one adsorption panel extends toward the shield side portion, and wherein said at least one adsorption panel comprises an adsorption area on a back surface thereof, the adsorption area configured to adsorb a gas molecule reflected from the plurality of cryopanels.

11. The cryopump according to claim 1, wherein a slit is formed on at least one of the plurality of cryopanels in order to allow a gas molecule to pass through said at least one of the plurality of cryopanels.

12. The cryopump according to claim 1, wherein a depth of an inclined clearance formed between the inclined area of the first cryopanel and the inclined area of the second cryopanel is larger than a width of an inlet of the inclined clearance.

13. A cryopump structure comprising a plurality of cryosorption panels, wherein each of the plurality of cryosorption panels comprises an inclined front surface that is close to a cryopump inlet on a radially outer side thereof and that is away from the inlet on a radially inner side thereof, the inclined front surface having a non-adsorption area, wherein at least half a width of the cryosorption panel in a radial direction from a cryopump central axis corresponds to the inclined front surface, and wherein the plurality of cryosorption panels are arranged in a nested manner such that one cryosorption panel out of two adjacent cryosorption panels that is close to the cryopump inlet extends toward the cryopump inlet over a non-adsorption area of the other cryosorption panel that is away from the cryopump inlet.

14. The cryopanel structure according to claim 13, wherein each of the plurality of cryosorption panels has an inverted frustum shape having a large dimension at a side close to the cryopump inlet and having a small dimension at a side far from the cryopump inlet, and wherein the plurality of cryosorption panels are arranged such that said other cryosorption panel surrounds said one cryosorption panel.

15. The cryopump according to claim 13, wherein the non-adsorption area is formed on an outer circumferential portion of the plurality of cryosorption panels that is visually recognized through the cryopump inlet.

16. A cryopump structure comprising a plurality of cryosorption panels, wherein each of the plurality of cryosorption panels comprises an inclined front surface that is close to a cryopump inlet on a radially outer side thereof and that is away from the inlet on a radially inner side thereof, the inclined front surface having an inclination angle toward a radiation shield, wherein at least half of a width of the cryosorption panel in a radial direction from a cryopump central axis corresponds to the inclined front surface, and wherein the plurality of cryosorption panels are arranged in a nested manner such that one cryosorption panel out of two adjacent cryosorption panels that is close to the cryopump inlet extends toward the cryopump inlet over an upper end of the other cryosorption panel that is away from the cryopump inlet.

* * * * *